US006723222B2

(12) United States Patent
Bergsma et al.

(10) Patent No.: US 6,723,222 B2
(45) Date of Patent: Apr. 20, 2004

(54) CU-NI-FE ANODES HAVING IMPROVED MICROSTRUCTURE

(75) Inventors: S. Craig Bergsma, The Dalles, OR (US); Craig W. Brown, The Dalles, OR (US)

(73) Assignee: Northwest Aluminum Company, The Dalles, OR (US)

( * ) Notice: Subject to any disclaimer, the term of this patent is extended or adjusted under 35 U.S.C. 154(b) by 100 days.

(21) Appl. No.: 10/126,087

(22) Filed: Apr. 22, 2002

(65) Prior Publication Data

US 2003/0196909 A1 Oct. 23, 2003

(51) Int. Cl.[7] ..... C25C 3/08; C25C 3/00

(52) U.S. Cl. ..... 205/385; 205/394; 204/244; 204/293

(58) Field of Search ..... 205/385; 204/293, 204/243.1–245

(56) References Cited

U.S. PATENT DOCUMENTS

| | | | | |
|---|---|---|---|---|
| 3,943,048 A | | 3/1976 | Fisher et al. | 204/290 |
| 3,957,600 A | | 5/1976 | Ives et al. | 204/105 R |
| 4,049,887 A | | 9/1977 | Whittingham | 429/112 |
| 4,202,708 A | * | 5/1980 | Bates et al. | 148/11.5 C |
| 4,288,302 A | | 9/1981 | De Nora et al. | 204/105 |
| 4,592,812 A | | 6/1986 | Beck et al. | 204/67 |
| 4,620,905 A | | 11/1986 | Tarcy et al. | 204/64 |
| 4,865,701 A | | 9/1989 | Beck et al. | 204/67 |
| 4,871,437 A | | 10/1989 | Marschman et al. | 204/291 |
| 4,871,438 A | | 10/1989 | Marschman et al. | 204/291 |
| 4,956,068 A | | 9/1990 | Nguyen et al. | 204/242 |
| 4,960,494 A | | 10/1990 | Nguyen et al. | 204/67 |
| 4,999,097 A | | 3/1991 | Sadoway | 204/243 |
| 5,006,209 A | | 4/1991 | Beck et al. | 204/67 |
| 5,017,244 A | * | 5/1991 | Sankaranarayanan et al. | 148/3 |
| 5,069,771 A | | 12/1991 | Nguyen et al. | 204/292 |
| 5,284,562 A | | 2/1994 | Beck et al. | 204/243 |
| 5,529,494 A | | 6/1996 | Vlacancich | 433/105 |
| 5,637,239 A | | 6/1997 | Adamski et al. | 219/69.15 |
| 5,667,649 A | | 9/1997 | Bushman | 204/290 |
| 5,725,744 A | | 3/1998 | de Nora et al. | 204/244 |
| 5,993,637 A | | 11/1999 | Hisamatsu et al. | 205/652 |
| 6,103,090 A | | 8/2000 | de Nora et al. | 205/384 |
| 6,126,799 A | | 10/2000 | Ray et al. | 204/291 |
| 6,217,739 B1 | | 4/2001 | Ray et al. | 205/385 |
| 6,248,227 B1 | | 6/2001 | de Nora et al. | 205/230 |

* cited by examiner

*Primary Examiner*—Donald R. Valentine
(74) *Attorney, Agent, or Firm*—Andrew Alexander

(57) ABSTRACT

A method of producing aluminum in a low temperature electrolytic cell containing alumina dissolved in an electrolyte. The method comprises the steps of providing a molten electrolyte having alumina dissolved therein in an electrolytic cell containing the electrolyte. A non-consumable anode and cathode is disposed in the electrolyte, the anode comprised of Cu—Ni—Fe alloys having single metallurgical phase. Electric current is passed from the anode, through the electrolyte to the cathode thereby depositing aluminum on the cathode, and molten aluminum is collected from the cathode.

31 Claims, 2 Drawing Sheets

500x

24 μm

200x

60 μm

CU-NI-FE ANODES HAVING IMPROVED MICROSTRUCTURE

The invention embodied in the subject matter described herein was made during work financed by the following government contract: Department of Energy Office of Industrial Technologies Contract #DE-FC07-98ID13662.

BACKGROUND OF THE INVENTION

This invention relates to electrolytic production of aluminum from alumina and more particularly, it relates to an improved anode for use in a cell for the electrolytic production of aluminum.

In the electrolytic production of aluminum, there is great interest in utilizing an anode substantially inert to the electrolyte and which does not react with oxygen during cell operation. Anodes of this type are described in U.S. Pat. No. 4,399,008 which discloses a composition suitable for fabricating into an inert electrode for use in the electrolytic production of metal from a metal compound dissolved in a molten salt. The electrode comprises at least two metal oxides combined to provide a combination metal oxide.

Also, U.S. Pat. No. 5,284,562 discloses an oxidation resistant, non-consumable anode for use in the electrolytic reduction of alumina to aluminum, which has a composition comprising copper, nickel and iron. The anode is part of an electrolytic reduction cell comprising a vessel having an interior lined with metal which has the same composition as the anode. The electrolyte is preferably composed of a eutectic of $AlF_3$ and either (a) NaF or (b) primarily NaF with some of the NaF replaced by an equivalent molar amount of KF or KF and LiF.

U.S. Pat. No. 5,069,771 discloses a method of electrowinning a metal by electrolysis of a melt containing a dissolved species of the metal to be won using a non-consumable anode having a metal, alloy or cermet substrate and an operative anode surface which is a protective surface coating of cerium oxyfluoride preserved by maintaining in the melt a suitable concentration of cerium. The anode is provided with an electronically conductive oxygen barrier on the surface of the metal, alloy or cermet substrate. The barrier layer may be a chromium oxide film on a chromium-containing alloy substrate. Preferably the barrier layer carries a ceramic oxide layer, e.g. of stabilized copper oxide which acts as anchorage for the cerium oxyfluoride.

U.S. Pat. No. 3,957,600 discloses anodes of alloys, which may be fragmented and used in baskets, of passive film-forming metals and elements having atomic numbers 23–29 for use in electrowinning metals, methods of using such anodes, and electrowinning cells incorporating such anodes.

Further, U.S. Pat. No. 5,529,494 discloses a monolithic bipolar electrode for the production of primary aluminum by molten salt electrolysis composed of a cermet anodic layer, a conductive and diffusion-resistant intermediate layer, and a refractory hard metal cathodic layer, with the edges covered by an electrolyte-resistant coating. The intermediate conductive layer has a coefficient of thermal expansion intermediate to the anodic and cathodic layers.

U.S. Pat. No. 4,620,905 discloses an electrolytic process comprising evolving oxygen on an anode in a molten salt, the anode comprising an alloy comprising a first metal and a second metal, both metals forming oxides, the oxide of the first metal being more resistant than the second metal to attack by the molten salt, the oxide of the second metal being more resistant than the first metal to the diffusion of oxygen. The electrode may also be formed of $CuAlO_2$ and/or $Cu_2O$.

U.S. Pat. No. 4,871,438 discloses cermet electrode compositions comprising NiO—$NiFe_2O_4$—Cu—Ni, and methods for making the same. Addition of nickel metal prior to formation and densification of a base mixture into the cermet allows for an increase in the total amount of copper and nickel that can be contained in the NiO—$NiFe_2O_4$ oxide system. Nickel is present in a base mixture weight concentration of from 0.1% to 10%. Copper is present in the alloy phase in a weight concentration of from 10% to 30% of the densified composition.

U.S. Pat. No. 4,999,097 discloses improved electrolytic cells and methods for producing metals by electrolytic reduction of a compound dissolved in a molten electrolyte. In the improved cells and methods, a protective surface layer is formed upon at least one electrode in the electrolytic reduction cell and, optionally, upon the lining of the cell.

U.S. Pat. No. 5,006,209 discloses that finely divided particles of alumina are electrolytically reduced to aluminum in an electrolytic reduction vessel having a plurality of vertically disposed, non-consumable anodes and a plurality of vertically disposed, dimensionally stable cathodes in closely spaced, alternating arrangement with the anodes.

U.S. Pat. No. 4,865,701 discloses that alumina is reduced to molten aluminum in an electrolytic cell containing a molten electrolyte bath composed of halide salts and having a density less than alumina and aluminum and a melting point less than aluminum. The cell comprises a plurality of vertically disposed, spaced-apart, non-consumable, dimensionally stable anodes and cathodes. Alumina particles are dispersed in the bath to form a slurry. Current is passed between the electrodes, and oxygen bubbles form at the anodes, and molten aluminum droplets form at the cathodes. The oxygen bubbles agitate the bath and enhance dissolution of the alumina adjacent the anodes and inhibit the alumina particles from settling at the bottom of the bath. The molten aluminum droplets flow downwardly along the cathodes and accumulate at the bottom of the bath.

U.S. Pat. No. 6,248,227 discloses a non-carbon, metal-based slow-consumable anode of a cell for the electrowinning of aluminium self-forms during normal electrolysis an electrochemically-active oxide-based surface layer (20). The rate of formation (35) of the layer (20) is substantially equal to its rate of dissolution (30) at the surface layer/electrolyte interface (25) thereby maintaining its thickness substantially constant, forming a limited barrier controlling the oxidation rate (35). The anode (10) usually comprises an alloy of iron with at least one of nickel, copper, cobalt or zinc which during use forms an oxide surface layer (20) mainly containing ferrite.

U.S. Pat. No. 6,217,739 discloses a method of producing commercial purity aluminum in an electrolytic reduction cell comprising inert anodes. The method produces aluminum having acceptable levels of Fe, Cu and Ni impurities. The inert anodes used in the process preferably comprise a cermet material comprising ceramic oxide phase portions and metal phase portions.

U.S. Pat. No. 4,288,302 discloses novel dimensionally stable electrodes constituted by a film forming metallic material alloyed with at least one member of the group consisting of metal belonging to Groups VIB, VIIB, VIII, IIB, IB, IVA, lanthanum and lanthanide series of the Periodic Table, such as chromium, manganese, rhenium, iron, ruthenium, osmium, cobalt, rhodium, iridium, nickel, palladium, platinum, copper, silver, gold, zinc, cadmium, silicon, germanium, tin, lead and lanthanum having an electroconductive and corrosion resistant surface preactivated on the surface thereof, preparation of said electrodes, use of said electrodes as anodes for electrolysis in aqueous and organic solutions or in fused salts as well as for cathodic protection and electrolysis methods using said electrodes.

U.S. Pat. No. 4,620,905 discloses an electrolytic process comprising evolving oxygen on an anode in a molten salt, the anode comprising an alloy comprising a first metal and a second metal, both metals forming oxides, the oxide of the first metal being more resistant than the second metal to attack by the molten salt, the oxide of the second metal being more resistant than the first metal to the diffusion of oxygen. The electrode may also be formed of $CuAlO_2$ and/or $Cu_2O$.

Additional anode compositions are described in U.S. Pat. Nos. 3,943,048; 4,049,887; 4,956,068; 4,960,494; 5,637,239; 5,667,649; 5,725,744 and 5,993,637.

There is still a need to improve the corrosivity and conductivity of the non-consumable anode to ensure an anode that provides satisfactory performance without dissolution in an electrolytic cell where alumina is reduced to aluminum.

SUMMARY OF THE INVENTION

It is an object of this invention to provide an improved anode for use in an electrolytic cell.

It is another object of this invention to provide an improved composition for an anode having resistance to molten electrolyte salts in an aluminum producing electrolytic cell.

Yet, it is another object of the invention to provide a process for electrolytically producing aluminum from alumina in a low temperature cell using an improved anode.

And yet it is a further object of the invention to provide an improved anode comprised of Cu—Ni—Fe.

These and other objects will become apparent from a reading of the specification, claims and drawings appended hereto.

In accordance with these objects, there is provided a method of producing aluminum in an electrolytic cell comprising the steps of providing molten electrolyte in an electrolytic cell, said cell having alumina dissolved in the electrolyte. In addition, anodes and cathodes are provided in the cell, the anodes comprised of Cu—Ni—Fe alloys, incidental elements and impurities and having a single microstructural phase. Electric current is passed between anodes and cathodes in the cell and aluminum is formed at the cathodes.

The anode has improved resistance to oxidation and corrosion in molten electrolyte baths compared to other anode compositions in the same bath. Preferably, the anode composition is comprised of 15 to 60 wt. % Ni, 1 to 50 wt. % Fe, the remainder Cu, incidental elements and impurities. A more preferred anode is selected from a composition in the range of 10 to 70 wt. % Cu, 15 to 60 wt. % Ni, and 15 to 40 wt. % Fe. A typical composition for the anode would contain 30 to 50 wt. % Cu, 20 to 40 wt. % Ni, and 20 to 40 wt. % Fe, with a specific composition containing about 42 wt. % Cu, 28 wt. % Ni, and 30 wt. % Fe.

Another feature of the present invention is a cell vessel interior lining which is impervious to penetration by molten electrolyte, which can be readily replaced and which may be readily recycled. The lining covers the bottom and walls of the vessel interior and may be composed of an alloy having substantially the same composition as the anode composition described herein. Located between the external shell and the interior metal lining of the vessel is refractory material, such as alumina or insulating fire brick, which thermally insulates the bottom and walls of the vessel. The interior metal lining may be electrically connected to the anodes, and the walls or bottom or both and constitute part of the anode arrangement. During operation of the cell, oxygen bubbles are generated at the bottom and elsewhere on the interior metal lining when the latter is part of the anode arrangement, and these bubbles help to maintain in suspension in the molten electrolyte the finely divided alumina particles introduced into the cell.

The anodes of the present invention may be fabricated by casting a Cu—Ni—Fe melt of the desired composition. When Cu—Ni—Fe melts are cast into solid material, the casting or anode exhibits multiple microstructural phases. The multiple microstructural phases can be converted to a single phase by heating, thus providing a more uniform microstructure having fewer sites depleted or concentrated in elements constituting the anode.

Preferably, a cell in accordance with the present invention employs, as an electrolyte, a eutectic or near-eutectic composition consisting essentially of 42–46 mol. % $AlF_3$ (preferably 43–45 mol. % $AlF_3$) and 54–58 mol. % of either (a) all NaF or (b) primarily NaF with equivalent molar amounts of KF or KF plus LiF replacing some of the NaF.

Thus, the invention includes a method of producing aluminum in a low temperature electrolytic cell containing alumina dissolved in a molten electrolyte. The method comprises the steps of providing a molten electrolyte having alumina dissolved therein in an electrolytic cell and an anode and a cathode disposed in said electrolyte. The anode is comprised of a Cu—Ni—Fe alloy having multiple microstructural phases which is heated to provide a single microstructural phase. Electric current is passed from the anode through the electrolyte to the cathode, thereby depositing aluminum on the cathode, and molten aluminum is collected from the cathode.

DETAILED DESCRIPTION OF THE PREFERRED EMBODIMENTS

Anodes of the present invention may be employed in any aluminum producing electrolytic cell. Further, the anodes may be used with any electrolyte which does not oxidize or cause degradation of the electrode during electrolysis. Preferred electrolytes are set forth in our U.S. Pat. No. 5,284,562 incorporated herein by reference as if specifically set forth.

Figure 1:
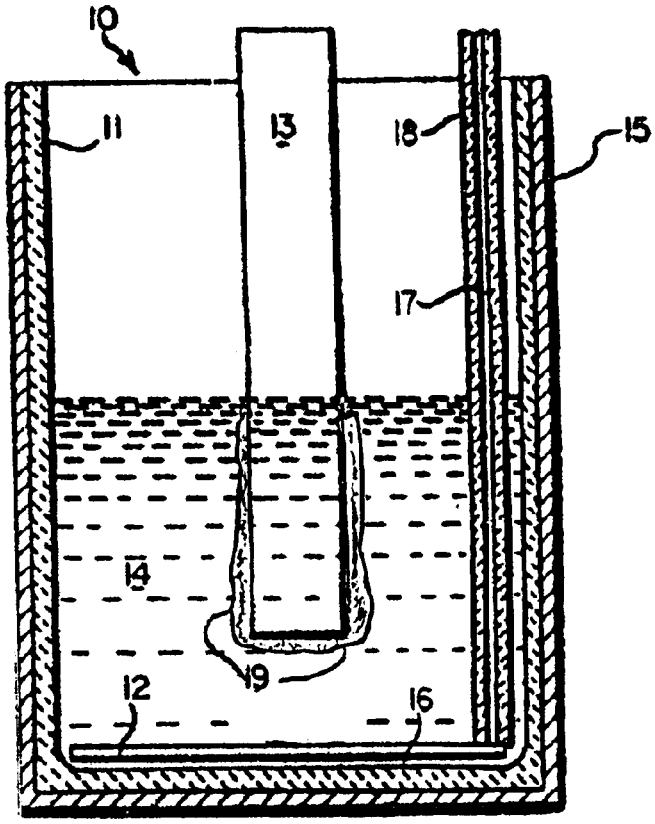
FIG. 1 is a vertical cross-sectional view of a test cell used for testing anodes of the invention.

Referring to FIG. 1, there is shown a laboratory electric cell referred to generally as 10 used for testing anodes in accordance with the invention. Cell 10 comprises an alumina crucible 11 containing an anode 12, a cathode 13, and a molten electrolyte bath 14. Alumina crucible 11 is positioned within a stainless steel container 15. As shown in FIG. 1, the inner surface of the sidewall of container 15 and the outer surface of the sidewall of crucible 11 are in abutting relation. In practice, a space can exist between the respective sidewalls of container 15 and crucible 11. In such a case, the space may be filled with graphite or petroleum coke particles to assist in the uniform distribution of heat to the sidewall of crucible 11.

Cathode 13 is typically a slab of titanium diboride, a composite of titanium diboride and graphite, or molybdenum. Anode 12 is in the form of a metal disc overlying and substantially covering the bottom 16 of crucible 11. A vertical copper conductor 17 has a lower end connected to disc 12 and an upper end connected to a source of electric current (not shown). Vertical conductor 17 is insulated with an alumina tube 18 so as to confine the anodic current to disc 12. Cathode 13 is connected in a conventional manner to the source of electric current. Cell 10 is placed in a furnace and held at a temperature at which electrolyte bath 14 is molten (e.g., 680–800° C.). The temperature of bath 14 is measured continuously with a chromel-alumel thermocouple contained in a closed-end fused alumina tube (not shown).

Cell 10 is described in detail in U.S. Pat. No. 5,284,562, cited above.

Electrolyte bath 14 comprises a mixture of fluorides and has a relatively low melting point which enables operation of cell 10 at a relatively low temperature (e.g., 680–800° C.). The electrolyte comprises a mixture of fluorides having a eutectic or near-eutectic composition, a composition providing the lowest temperature at which the mixture of fluorides is molten. Examples of such electrolytes are described in detail in U.S. Pat. Nos. 5,006,209 and 5,284,562, fully incorporated herein by reference as if specifically set forth.

One eutectic or near-eutectic composition consists essentially of 42–46 mol. % $AlF_3$ (preferably 43–45 mol. % $AlF_3$) and 54–58 mol. % of either (a) all NaF or (b) primarily NaF with equivalent mol amounts of either KF or LiF or KF plus LiF replacing some of the NaF. An example of the exact eutectic composition for this embodiment of electrolyte is 44 mol. % $AlF_3$ (61.1 wt. %) and 56 mol. % NaF (38.9 wt. %). Another example of this embodiment comprises 46.7 mol. % $AlF_3$, 36.7 mol. % NaF, 8.3 mol. % KF and about 8.3 mol. % LiF. In parts by weight, this example comprises 66 parts $AlF_3$, 26 parts NaF, 8 parts KF and 3–4 parts LiF. The cell can use electrolytes that contain one or more alkali metal fluorides and at least one metal fluoride, e.g., aluminum fluoride, and use a combination of fluorides as long as such baths or electrolytes operate at less than about 900° C. For example, the electrolyte can comprise NaF and $AlF_3$. That is, the bath can comprise 53 to 62 mol. % NaF and 38 to 47 mol. % $AlF_3$.

It will be appreciated that the anode composition can be used with other electrolyte bath compositions and such is intended within the purview of the invention. For example, the electrolyte can contain one or more alkali metal fluorides and at least one other metal fluoride, e.g., aluminum, calcium or magnesium fluoride, as long as such baths can be operated at less than about 900° C.

Electrolyte bath 14 may have a composition containing a mixture of two eutectics comprising NaF:$AlF_3$ eutectic plus KF:$AlF_3$ eutectic plus up to 4 wt. % LiF. This electrolyte composition is discussed in detail in U.S. Pat. No. 5,006,209, cited above. Expressed in terms of the amount of individual ingredients included therein, the electrolyte consists essentially of, in wt. % adjusted to exclude impurities: 6–26 NaF, 7–33 KF, 1–6 LiF and 60–65 $AlF_3$.

Anode 12 is a Cu—Ni—Fe anode which is substantially non-consumable at the temperatures at which cell 10 is operated. Fe in the anodes may range from 1 to 45 wt. % and Cu can range from 10 to 70 wt. %. Ni can range from 15 to 60 wt. %. Suitable anode compositions are in the ranges of 10 to 70 wt. % Cu, 15 to 60 wt. % Ni, the remainder Fe, incidental elements and impurities. The Fe can be in the range of 1 to 40 wt. %. Preferably, anode compositions are in the ranges of 35 to 70 wt. % Cu, 25 to 48 wt. % Ni, the remainder Fe with suitable amounts of Fe being in the range of 2 to 17 wt. %. More preferably, anode compositions can be selected from the range of 45 to 70 wt. % Cu, 28 to 42 wt. % Ni, and 13 to 17 wt. % Fe. The ranges set forth herein are intended to include all the numbers within the range as if specifically set forth. A more detailed discussion of the composition of anode 12, together with a number of specific examples of anode composition, is contained in U.S. Pat. No. 5,284,562.

Inert anodes in accordance with the invention may be cast from a melt of an alloy having the desired composition or the anodes may be fabricated from powders of the individual components mixed in the desired proportions. The powders are then sintered or melted to form the anode.

Cathode 13 may be composed of any suitable material that is wet by molten aluminum and that is not degraded by the molten electrolyte bath. Examples of suitable cathode materials include titanium diboride, zirconium diboride, titanium carbide, zirconium carbide, or a composite of titanium diboride and graphite (e.g., 50 wt. % graphite), or molybdenum.

The molten electrolyte contains dissolved alumina. However, alumina in excess of the dissolved alumina can be provided in the electrolyte. That is, incorporated into molten electrolyte bath 14 may be finely divided particles of alumina; the weight of the added alumina is typically about 5–15% of the weight of the fluoride electrolyte. The mean particle size of the alumina particles is typically about 1–100 microns, for example. Alumina dissolves in molten electrolyte bath 14 when cell 10 is operated in the temperature range 750–900° C. Thus, typically the fluoride electrolyte bath will contain about 1–5 wt. % dissolved alumina.

When current is supplied to cell 10, electrolytic reduction of alumina to aluminum occurs. Aluminum is deposited at cathode 13, and oxygen is liberated at anode 12. That is, aluminum forms at cathode 13, and gaseous oxygen forms at anode 12. Molten aluminum wets the surface of cathode 13. Bubbles of gaseous oxygen form at anode 12. Quantities of molten aluminum accumulate on the cathode 13 as a continuous phase 19 of molten aluminum.

Figure 2:
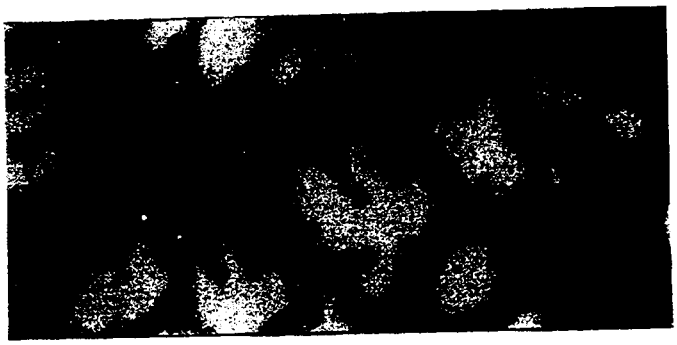
FIG. 2 is a micrograph showing multiple phase metallurgical structure of Cu—Ni—Fe cast anodes.
Figure 3:
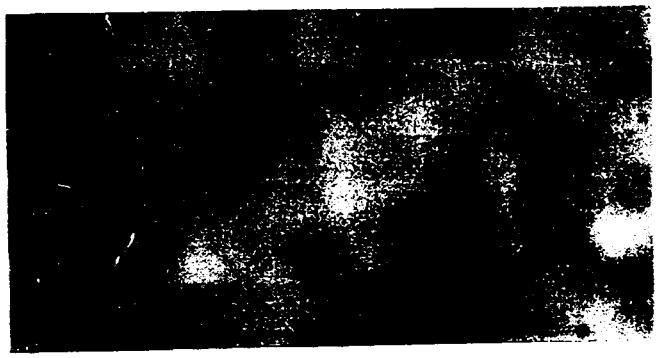
FIG. 3 is a micrograph showing single phase microstructure of a Cu—Ni—Fe cast anode of FIG. 3 after heating.

When an anode is fabricated from a melt of Cu—Ni—Fe by casting, normally two metallurgical phases or structures are produced, as shown in FIG. 2 which is a micrograph at 500× of the structure having 60 wt. % Cu, 20 wt. % Ni, and 70 wt. % Fe. (atom % shown in FIG. 2.) By homogenizing or heating the cast anode a phase change can be obtained. The two phases are changed into a single phase shown in FIG. 3 which is a micrograph at 200× of the homogenized structure. That is, the two phases are changed into a single phase. The homogenization can be carried out at sufficiently high temperature and for a sufficiently long time to obtain a single phase metallurgical structure. Thus, for example, the cast anode can be homogenized in a temperature range of 950° to 1250° C. for about 1 to 12 hours. A typical temperature range for homogenizing is about 1000° to 1100° C. with lower temperatures requiring longer times and higher temperatures requiring shorter times to effect a phase change. A specific temperature which will effect a phase change in a cast anode is about 1100° C. The time at this temperature is typically about 8 hours; however, longer or shorter times may be required, depending on the compositions.

The single phase has the benefit that it offers a more uniform microstructure for an anode surface with less competing structures subject to oxidation. Further, it offers more resistance to attack by insipient diffusion of the copper rich as-cast matrix.

The following examples are further illustrative of the invention.

EXAMPLE 1

To test the invention, an anode having about 70 wt. % Cu, 15 wt. % Ni, 15 wt. % Fe was "cast" to shape and used in a 10 amp electrolytic cell, as shown in FIG. 1, operated at about 760° C. The cell was maintained at anode potential of ~3.9V. The molten electrolyte used in the cell contained about 61 wt. % $AlF_3$ and 39 wt. % NaF. The circular anode had a size of about 2 inches in diameter and about 0.25 inch thick. A 6% slurry of alumina having a particle size of about 1 $\mu$m was maintained in the molten electrolyte. The cell utilized a titanium diboride cathode placed to provide an anode-cathode distance of 0.5 inch. Aluminum produced remained attached to the cathode as shown in FIG. 1. The cell was run for a total of 5 hours at an anode current density of about 0.5 amps/cm$^2$. After the 5 hours, the anode was removed and weighed. The current efficiency was about 76%. The product aluminum showed 0.056 wt. % Cu contamination, but no detectable contamination from Ni or Fe.

While the invention has been described in terms of preferred embodiments, the claims appended hereto are intended to encompass other embodiments which fall within the spirit of the invention.

What is claimed is:

1. A method of producing aluminum in a low temperature electrolytic cell containing alumina dissolved in a molten electrolyte, the method comprising the steps of:

(a) providing a molten electrolyte having alumina dissolved therein in an electrolytic cell;

(b) providing an anode and a cathode disposed in said electrolyte, the anode consisting essentially of a Cu—Ni—Fe alloy having a single microstructural phase;

(c) passing electric current from said anode through said electrolyte to said cathode thereby depositing aluminum on said cathode; and (d) collecting molten aluminum from said cathode.

2. The method in accordance with claim 1 including operating said cell to maintain said electrolyte in a temperature range of about 660° to 800° C.

3. The method in accordance with claim 1 including using an electrolyte comprised of one or more alkali metal fluorides.

4. The method in accordance with claim 1 including maintaining up to 30 wt. % undissolved alumina particles in said electrolyte to provide a slurry therein.

5. The method in accordance with claim 4 wherein undissolved alumina has a particle size in the range of 1 to 100 $\mu$m.

6. The method in accordance with claim 1 wherein Fe in said anode ranges from 1 to 50 wt. %.

7. The method in accordance with claim 1 including passing an electric current through said cell at a current density in the range of 0.1 to 1.5 A/cm$^2$.

8. The method in accordance with claim 1 including using a cathode comprised of a material selected from the group consisting of titanium diboride, zirconium boride, titanium carbide, zirconium carbide and titanium.

9. The method in accordance with claim 1 including providing said anode and said cathode substantially vertical or upright in said electrolyte and arranging said anodes and said cathode in alternating relationship.

10. The method in accordance with claim 1 wherein said anode is comprised of 10 to 70 wt. % Cu, and 15 to 60 wt. % Ni, the remainder iron, incidental elements and impurities.

11. The method in accordance with claim 1 wherein said anodes are cast from a melt of Cu—Ni—Fe and heated to provide said single microstructural phase.

12. The method in accordance with claim 1 wherein said cell is comprised of metal bottom and sidewalls for containing said electrolyte, at least one of said bottom and sidewalls comprised of a composition which is the same as said anode.

13. The method in accordance with claim 1 wherein said electrolyte is comprised of one or more alkali metal fluorides and at least one metal fluoride.

14. The method in accordance with claim 13 wherein at least one of said metal bottom and sidewalls are electrically connected to said anodes thereby making at least one of said bottom and sidewalls anodic.

15. The method in accordance with claim 1 wherein said electrolyte is comprised of NaF and $AlF_3$.

16. A method of producing aluminum in a low temperature electrolytic cell containing alumina dissolved in an electrolyte, the method comprising the steps of:

(a) providing a cell comprising a vessel having a bottom and walls extending upwardly from said bottom for containing electrolyte;

(b) providing a molten electrolyte having alumina dissolved therein in said vessel;

(c) providing a plurality of generally vertically disposed anodes and a plurality of generally vertically disposed cathodes in said electrolyte in alternating relationship with said anodes, wherein said anodes are cast anodes consisting essentially of about 10 to 70 wt. % Cu, 15 to 60 wt. % Ni, and 15 to 40 wt. % Fe and having a single microstructural phase;

(d) passing an electric current through said vessel to said anodes and through said electrolyte to said cathodes, thereby depositing aluminum on said cathodes; and (e) collecting aluminum from said cathodes.

17. The method in accordance with claim 16 wherein said electrolyte is comprised of one or more alkali metal fluorides and at least one metal fluoride.

18. The method in accordance with claim 16 wherein said electrolyte is comprised of NaF and $AlF_3$.

19. The method in accordance with claim 16 wherein said cast anodes are heated to provide said single metallurgical phase.

20. The method in accordance with claim 19 wherein said electrolyte is comprised of one or more alkali metal fluorides and at least one metal fluoride.

21. In an electrolytic cell for the production of aluminum from alumina dissolved in an electrolyte contained in the cell, wherein a plurality of non-consumable anodes and cathodes are disposed in a vertical direction in the electrolyte in alternating relationship wherein electric current is passed from said anodes through said cathodes and aluminum is deposited on said cathodes, the improvement wherein said anodes are cast anodes having a single microstructural phase consisting essentially of 10 to 70 wt. % Cu, and 15 to 60 wt. % Ni, the balance Fe and incidental elements and impurities.

22. An electrolytic cell for the production of aluminum from alumina dissolved in an electrolyte contained in the cell, the cell comprising:

(a) a vessel having a bottom and walls extending upwardly from said bottom, and an interior metal lining for containing electrolyte;

(b) a plurality of anodes disposed in said vessel, said anodes consisting essentially of 10 to 70 wt. % Cu, and 15 to 60 wt. % Ni, the balance Fe and incidental elements and impurities, the anodes are cast anodes having a single microstructural phase;

(c) a plurality of cathodes disposed in said vessel in alternating relationship with said anodes, said cell designed to pass electric current from said anodes through said electrolyte to said cathodes to deposit aluminum at said cathodes; and (d) means provided for removing aluminum from said cell.

23. The cell in accordance with claim 22 wherein said anodes are comprised of 10 to 70 wt. % Cu, 15 to 60 wt. % Ni, and 1 to 40 wt. % Fe.

24. A non-consumable anode suitable for use in a low temperature electrolytic cell for the production of aluminum from alumina dissolved in an electrolyte contained in the cell, the anode consisting essentially of copper, nickel and iron, incidental elements and impurities, the anode having a single microstructural phase.

25. The anode in accordance with claim 24 wherein the anode is comprised of 10 to 70 wt. % Cu, 15 to 60 wt. % Ni, and 1 to 40 wt. % Fe.

26. The anode in accordance with claim 24 wherein the anode is comprised of 20 to 50 wt. % Cu, 20 to 40 wt. % Ni, and 20 to 40 wt. % Fe.

27. The anode in accordance with claim 24 wherein said anode is composed of sintered metal powders.

28. The anode in accordance with claim 24 wherein said anode is a cast anode.

29. The anode in accordance with claim 24 wherein said anode is a cast anode subjected to homogenization to provide said single metallurgical phase.

30. The anode in accordance with claim 29 wherein said homogenization is carried out in a temperature range of 950° to 1250° C.

31. The anode in accordance with claim 24 wherein said anode is an anode cast from a melt having a composition of 10 to less than 50 wt. % Cu, and 15 to 60 wt. % Ni, the balance Fe, incidental elements and impurities.

* * * * *